US007140335B2

(12) United States Patent
Moretz et al.

(10) Patent No.: US 7,140,335 B2
(45) Date of Patent: Nov. 28, 2006

(54) DYNAMIC VALVE TIMING ADJUSTMENT MECHANISM FOR INTERNAL COMBUSTION ENGINES

(75) Inventors: Dale Moretz, Jackson, MI (US); Roy Kaywood, Jackson, MI (US)

(73) Assignee: Kaymor, LLC, Jackson, MI (US)

( * ) Notice: Subject to any disclaimer, the term of this patent is extended or adjusted under 35 U.S.C. 154(b) by 19 days.

(21) Appl. No.: 10/943,576
(22) Filed: Sep. 17, 2004

(65) Prior Publication Data

US 2006/0060159 A1 Mar. 23, 2006

(51) Int. Cl.
*F01L 1/14* (2006.01)

(52) U.S. Cl. ..... 123/90.17; 123/90.15; 123/90.31

(58) Field of Classification Search ..... 123/90.15, 123/90.16, 90.17, 90.18, 90.27, 90.31, 90.6, 123/345, 346, 347, 348
See application file for complete search history.

(56) References Cited

U.S. PATENT DOCUMENTS 1,885,796 A 11/1932 Boulet
2,057,354 A 10/1936 Withers et al.
2,839,036 A 6/1958 Strang (Continued)

FOREIGN PATENT DOCUMENTS

DE 42 40 631 A1 6/1994

(Continued)

*Primary Examiner*—Thomas Denion
*Assistant Examiner*—Ching Chan
(74) *Attorney, Agent, or Firm*—Young & Basile, P.C.

(57) ABSTRACT

A cam phaser is disclosed for adjusting the angular position of a camshaft relative to a crankshaft. In a first embodiment, a rotatable camshaft has an interior passageway and at least one cam operative to effect actuation of an engine valve. A first drive member is connectable to the crankshaft for rotational movement therewith. The first drive member is independently rotatably associated with the camshaft. A piston member is axially moveably disposed within the camshaft interior passageway and associated with the camshaft for rotation therewith. The piston member is further associated with the first drive member for rotation therewith and axial movement relative thereto. Axial movement of the piston member effects a change in the angular position of the first drive member. In a second embodiment, a rotatable tubular member has an interior passageway. A first drive member connectable to one or the other of a crankshaft or camshaft for rotational movement therewith is independently rotatably associated with the tubular member. A second drive member connectable to the other of a camshaft or crankshaft for rotational movement therewith is rotatably fixed relative to the tubular member. The first drive member is independently angularly positionable relative to the second drive member. A piston member is axially moveably disposed within the tubular member interior passageway and associated with the tubular member for rotation therewith. The piston member is further associated with the first drive member for rotation therewith and axial movement relative thereto. Axial movement of the piston member effects a change in the angular position of the first drive member relative to the second drive member.

23 Claims, 6 Drawing Sheets

U.S. PATENT DOCUMENTS

| | | | | |
|---|---|---|---|---|
| 2,888,837 | A | | 6/1959 | Hellman |
| 4,388,897 | A | | 6/1983 | Rosa |
| 4,811,698 | A | | 3/1989 | Akasaka et al. |
| 5,211,141 | A | * | 5/1993 | Hannibal et al. ..... 123/90.17 |
| 5,326,321 | A | | 7/1994 | Chang |
| 5,588,404 | A | | 12/1996 | Lichti et al. |
| 5,592,909 | A | | 1/1997 | Tsuruta |
| 5,592,910 | A | | 1/1997 | Suga et al. |
| 5,803,030 | A | | 9/1998 | Cole |
| 5,809,954 | A | | 9/1998 | Devine et al. |
| 5,860,328 | A | | 1/1999 | Regueiro |
| 5,881,690 | A | | 3/1999 | Park |
| 6,135,076 | A | | 10/2000 | Martinez |
| 6,167,854 | B1 | | 1/2001 | Regueiro |
| 6,199,522 | B1 | | 3/2001 | Regueiro |
| 6,405,696 | B1 | | 6/2002 | Borraccia et al. |
| 6,474,281 | B1 | | 11/2002 | Walters |
| 6,640,760 | B1 | | 11/2003 | Plasencia |
| 2003/0106513 | A1 | | 6/2003 | Kunz et al. |

FOREIGN PATENT DOCUMENTS

| | | | |
|---|---|---|---|
| DE | 198 25 814 | A1 | 12/1998 |
| JP | 01224407 | A | 9/1989 |

* cited by examiner

DYNAMIC VALVE TIMING ADJUSTMENT MECHANISM FOR INTERNAL COMBUSTION ENGINES

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

BACKGROUND OF THE INVENTION

The present invention pertains to apparatus employed in the dynamic (i.e., during engine operation) adjustment of valve-timing in internal combustion engines as a means of optimizing engine performance, including power output, torque, and fuel efficiency.

Internal combustion, reciprocating piston engines, such as the conventional four-cycle (i.e., intake/compression/combustion/exhaust), single overhead camshaft engine 10 shown in simplified cross-section in FIG. 1, utilize one or more intake valves 11 to allow air or a mixture of air and fuel into the cylinder 20 for combustion, as well as one or more exhaust valves 12 to allow combustion gases to exit the cylinder 20 following combustion. The operation of these valves 11, 12 is sequenced in order to repeatedly charge the cylinder 20 with fuel and air either ahead of (in the case of four-cycle engines) or during (in the case of two-cycle engines) the piston's 25 compression stroke, and to repeatedly permit the discharge of exhaust gasses during the exhaust cycle. More particularly, the operational timing of these valves 11, 12 is controlled by a camshaft 30 rotatably connected (including, for example, a sprocket, chain, belt, etc.) via a geared linkage (not shown) to a rotating crankshaft 35 which supports and moves each piston 25 within its associated cylinder 20.

Still referring to FIG. 1, each of the intake 11 and exhaust 12 valves is biased to a closed position, as shown, by a spring 13 or other biasing means. Each of the intake 11 and exhaust 12 valves is further mounted on (or, alternatively, provided in contact with via, for instance, a lifter/push-rod linkage) a pivotable rocker arm 14 or 15, respectively, which rocker arms are positioned to selectively contact one of several corresponding cam lobes 31 axially disposed along the length of the camshaft 30. During rotational movement of the camshaft 30, a specific one of the cam lobes 31 will engage one of the intake 11 or exhaust 12 valve rocker arms 14 or 15, respectively, causing temporary pivoting movement of the rocker arm and, correspondingly, linear movement of the associated valve against the bias of spring 13 to its open position. Upon movement of the cam lobe 31 out of engagement with a valve 11 or 12, that valve is urged back to the closed position thereof by the biasing force of spring 13.

As those skilled in the art will appreciate, the timing or angular position of the camshaft 30 relative to the crankshaft 35 is critical in effecting engine performance. Moreover, such timing is not ideally constant through all engine speeds. Rather, it is preferable, for optimizing engine performance, that operation of the intake and exhaust valves be advanced or retarded in response to various engine operating conditions, including variations in torque, temperature, the fuel/air mixtures, engine speed, etc. Thus, a fixed camshaft—that is, a camshaft with an unchanging angular position relative to the angular position of the crankshaft—at best provides optimum engine performance only in a narrow range of engine operation.

To address this problem various means have been proposed, the most commonplace of which are apparatus for dynamically varying the angular position of the camshaft relative to the crankshaft to thus alter valve operation timing as appropriate to the engine's operating condition at a given time. The structure of such apparatus, also known as cam phasing devices or, more commonly, simply as cam-phasers, is exemplified in FIG. 2, adapted from the disclosure of U.S. Pat. No. 5,588,404, assigned to General Motors Corporation, and which disclosure is incorporated herein by reference in its entirety. In general, such cam phasers comprise a first rotatable element 50 mounted to the end of a camshaft 60 for synchronous rotational movement therewith. The first element 50 includes helical splines 51 on its outer surface. A second rotatable element 52 surrounds the first element 50 concentrically and has a drive member 53, such as a wheel, pulley, or sprocket, driven by the engine crankshaft (not shown). On an inner surface, the second element 52 is also provided with helical splines 54 arranged oppositely from the splines 51. A piston 55 is positioned between the first 50 and second 52 elements, the piston having helical splines on both inner and outer surfaces thereof, respectively, which splines mesh with one or the other of the splines 51, 54. Through axial movement of the piston 55, accomplished by controlled hydraulic pressure, the several splined surfaces cooperatively interengage to cause counter-rotation of the first 50 and second 52 elements relative to each other, thus changing the angular position of the camshaft 60 relative to the engine crankshaft.

Conventional cam phasers such as described are characterized by a number of drawbacks, including their relatively large dimensions, which necessitate larger engine compartments that translate to higher production costs. Conventional cam phasers also tend to have a relatively high mass, which adds to the rotational mass of the engine. Moreover, this mass is disposed outside of the bearing envelope of the camshaft, which disposition equates to additional stress on the camshaft as well as the mounting bearings the for. Finally, conventional cam phasers are characterized by a complex construction comprising numerous interrelated, individual components. This complexity increases manufacture and assembly costs, and further reduces the operating life of the apparatus.

It would, accordingly, be desirable to provide a cam phaser that overcomes the drawbacks associated with conventional cam phasers.

SUMMARY OF THE DISCLOSURE

The present invention addresses and solves the problems discussed above, and encompasses other features and advantages, by providing a cam phaser for selectively adjusting the angular position of a camshaft relative to the angular position of a crankshaft to thereby alter the timing of valve operation in an internal combustion engine.

According to a first embodiment, the inventive cam phaser comprises a rotatable camshaft having an interior passageway and including on an exterior surface thereof at least one cam operative to effect actuation of an engine inlet or outlet valve; a first drive member connectable to a crankshaft for rotational movement therewith, the first drive member independently rotatably associated with the camshaft; and a piston member axially moveably disposed within the camshaft interior passageway and associated with the camshaft for rotation therewith. The piston member is associated with the first drive member for rotation therewith and axial movement relative thereto, and axial movement of the piston member effects a change in the angular position of the first drive member.

According to a second embodiment, the inventive cam phaser comprises a rotatable tubular member having an interior passageway; a first drive member connectable to one or the other of a crankshaft or a camshaft for rotational movement therewith, the first drive member independently rotatably associated with the tubular member; a second drive member connectable to the other of a camshaft or a crankshaft for rotational movement therewith; and a piston member axially moveably disposed within the tubular member interior passageway and associated with the tubular member for rotation therewith. The second drive member is rotatably fixed relative to the tubular member. The first drive member is independently angularly positionable relative to the second drive member. The piston member is associated with the first drive member for rotation therewith and axial movement relative thereto, and axial movement of the piston member effects a change in the angular position of the first drive member relative to the second drive member.

According to one feature of this invention, the piston member comprises a helical cam portion.

According to a further feature hereof, the first drive member comprises a cam following portion in engagement with the helical cam portion of the piston member, whereby axial movement of the piston member effects a change in the angular position of the first drive member.

Per one feature of the present invention, the cam following portion is defined by at least a portion of the axial passageway defined in the first drive member, the passageway being characterized by a cross-sectional shape complementary to the cross-sectional shape of the piston member first portion.

Per still another inventive feature, the piston member comprises a first portion axially slidingly received within a passageway defined in the first drive member, the passageway including an opening comprising the cam following portion, and wherein further the helical cam portion comprises at least one helical rib provided on the first portion of the piston member.

According to still another feature hereof, the opening comprises a keyway the cross-sectional shape of which is complementary to the cross-sectional shape of the piston member first portion.

Per yet another feature of the present invention, the helical cam portion comprises a helical slot, and the cam phaser further includes a guide member disposed in the helical slot and rotatably fixed relative to the camshaft, whereby axial movement of the piston member effects a change in the angular position of the piston member and the first drive member rotatably associated therewith.

According to still another feature, the piston member is selectively axially moveable between at least first and second positions. Per this feature, the piston member may be selectively axially moveable between one or more of the at least first and second positions by means of linear or radial solenoids, motors, hydraulic pressure, springs, etc. In one embodiment, the piston member may be spring-biased to one of the at least first and second positions, and selectively axially moveable by hydraulic pressure to the other of the at least first and second positions. Alternatively, the piston member is selectively axially moveable by hydraulic pressure between the at least first and second positions thereof.

BRIEF DESCRIPTION OF THE DRAWINGS

These and other objects, features, and advantages of the present invention will become apparent upon reference to the following written description and drawings, of which.

WRITTEN DESCRIPTION

Figure 2:
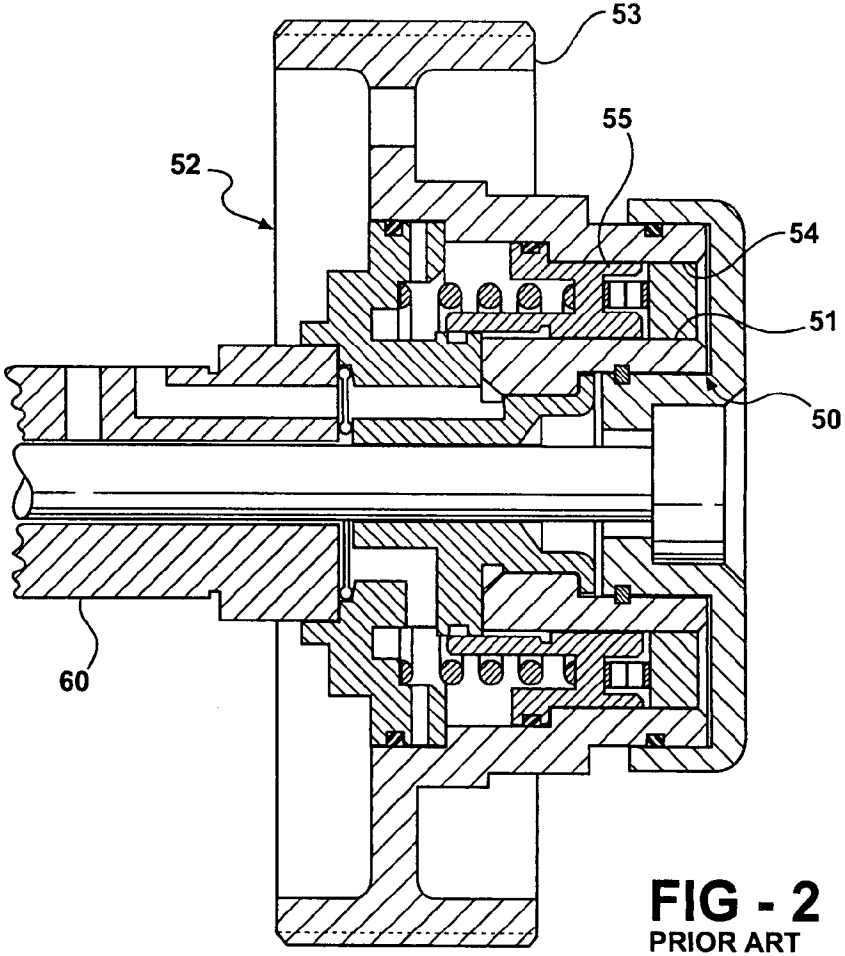
FIG - 2 PRIOR ART
FIG. 2 comprises a lateral cross-section of a prior art cam phaser assembly.
Figure 1:
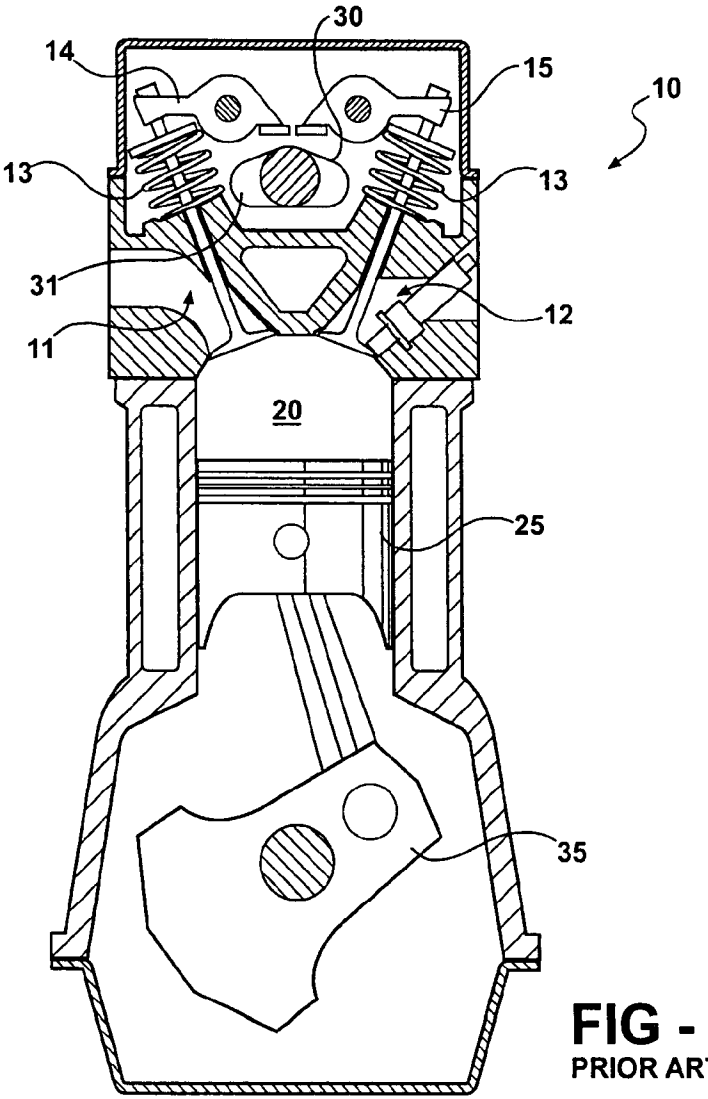
FIG - 1 PRIOR ART
FIG. 1 comprises a simplified cross-sectional view of a conventional, prior art four-cycle internal combustion engine with a single, overhead camshaft.

Referring now to the drawings, wherein like numerals indicate like or corresponding parts throughout the several views, the present invention will be seen to comprise a cam phaser for selectively adjusting the angular position of a camshaft relative to the angular position of a crankshaft in order to dynamically alter the timing of valve operation in an internal combustion engine.

Figures 3, 3A, 3B:
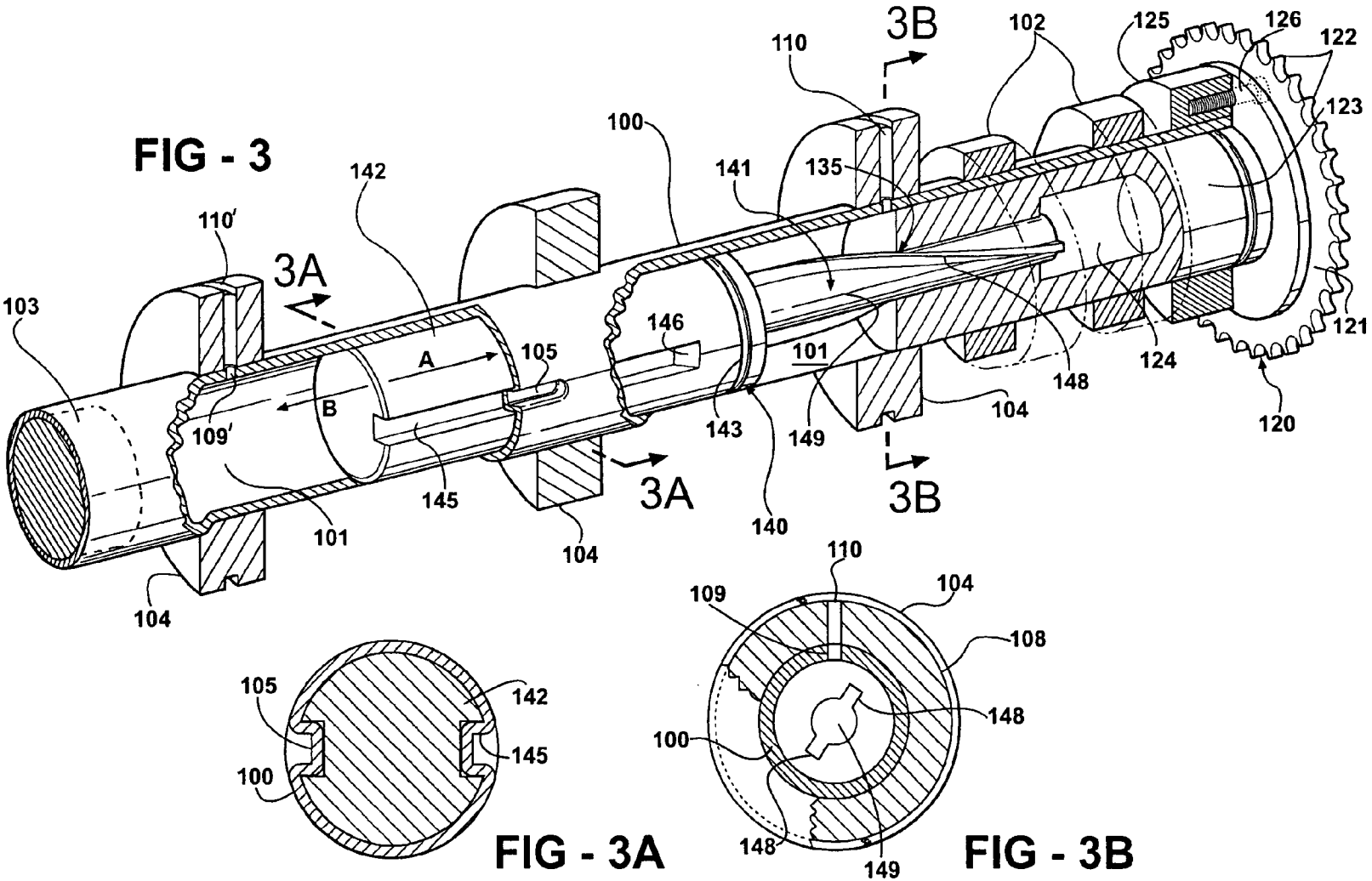
FIG. 3 comprises a cut-away perspective view of the inventive cam phaser according to one embodiment thereof.
FIGS. 3A and 3B comprise transverse cross-sections of the cam phaser as shown in FIG. 3.

With reference first to FIG. 3, the present invention will be seen to generally include, according to a first embodiment thereof, a rotatable camshaft 100 having an interior passageway 101 and including on an exterior surface thereof at least one cam 102 operative to effect actuation of an engine inlet or outlet valve (not shown), for example through engagement with the rocker arm of the valve, or, according to other conventional engine constructions, through direct action on the valve stem, actuation of a push-rod which pivots a valve rocker arm, etc. The camshaft 100 is rotatably mounted upon bearing supports 104. A first drive member 120, operatively connectable to a crankshaft (not shown) for rotatable movement therewith, for instance via a sprocket, gears, chain, belt or other conventional linkage means, is independently rotatably associated with the camshaft 100. A piston member 140 is axially moveably disposed within the camshaft interior passageway 101 and is associated with the camshaft 100 for synchronous rotation therewith. The piston member 140 is further associated with the first drive member 120 for synchronous rotation therewith and axial movement relative thereto. By means described further herein, axial movement of the piston member 140 in relation to the first drive member 120 effects a change in the angular position of the first drive member.

The passageway 101 may constitute a finite length of an otherwise solid camshaft or, as specifically illustrated, may be defined in a hollow camshaft by the provision of an internal plug or stop member 103.

To a first end of the camshaft 100 is rotatably mounted the first drive member 120. As shown, first drive member 120 comprises means for operative connection with a crankshaft (not shown), such as, for example, the illustrated sprocket 121 having disposed about the circumference thereof a plurality of radially projecting teeth 122 for interengagement with a linking chain. However, the depiction of sprocket 121 is not intended to be limiting of the instant invention, and it is contemplated that the first drive member 120 could, for instance, comprise a pulley or other conventional means for operatively connecting the first drive member 120 to the crankshaft (not shown). A coaxial stem portion 123 extends from a first surface of the sprocket 121. The stem portion 123 is dimensioned to be rotatably received within the passageway 101 in sealing engagement therewith, and includes an internal passageway 124 dimensioned to slidingly receive therein a first portion 141 of the piston member 140. The stem portion 123 may be formed integrally with the sprocket, as shown, or may be formed separately therefrom and subsequently connected thereto by known means. A coaxial, annular mounting portion 125 concentric with the stem portion 123 also extends from a first surface of the sprocket 121. The annular mounting portion 125 comprises a cylindrical, ring-shaped member the interior diameter of which approximates the outer diameter of the camshaft 100, such that the mounting portion 125 may be rotatably received on the exterior surface of the camshaft 100. The annular mounting portion 125 is shown as a separate element mounted to the sprocket 121 by fasteners 126 or like means. However, the mounting portion 125 may also be formed integrally with the sprocket 121.

Figure 4A:
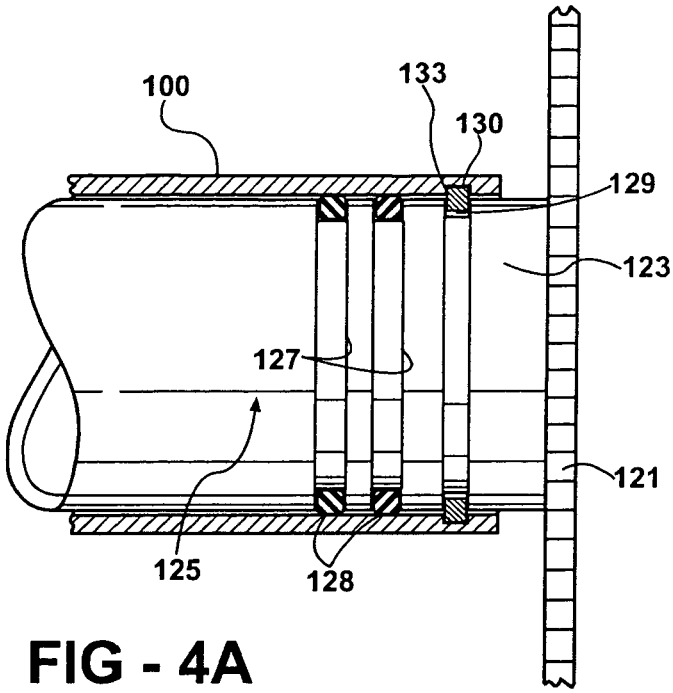
FIGS. 4A and 4B comprise detailed longitudinal, partial cross-sections illustrating two alterative embodiments for sealingly mounting the first drive member of the present invention to a tubular member or camshaft.
Figure 4B:
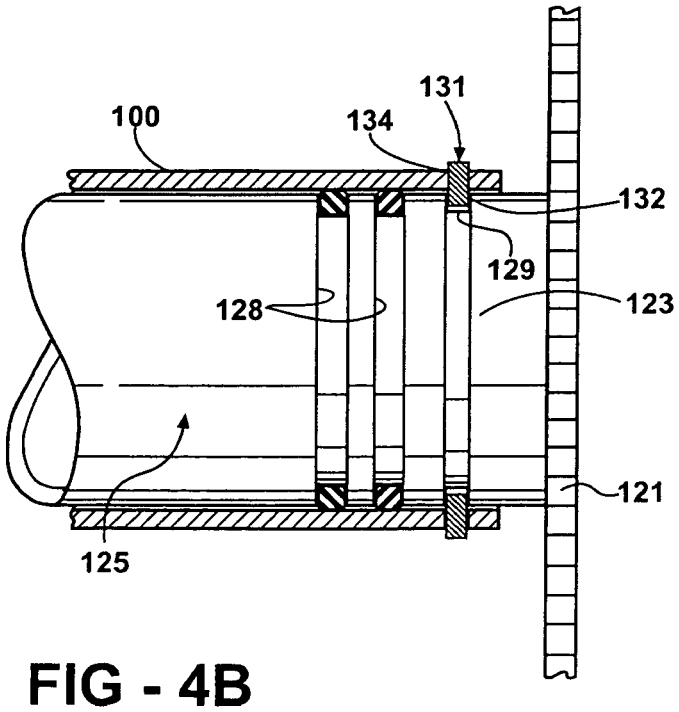

With reference also being had to FIGS. 4A and 4B, the first drive member 120 is sealingly mounted upon the tube or camshaft 100, and two embodiments of alternate means for such sealing mounting are shown. In particular, the stem portion 123 includes one or more annular channels 127 mounting compressible seals, such as the illustrated O-rings 128, and at least one further annular channel 129 for receiving either of a snap-ring 130 (FIG. 4A) or a U-clip 131 (FIG. 4B). According to the embodiment of FIG. 4A, snap-ring 130 is engageable with an axially aligned annular channel 133 provided in the interior surface of the camshaft 100. According to the embodiment of FIG. 4B, the U-clip 131 includes terminal tab portions 132 receivable through slots 134 defined through the circumferential wall of the camshaft 100 in axial alignment with the annular channel 129. Of course, it will be appreciated that the various aforedescribed means of mounting the first drive member 120 on the camshaft (or, in a further embodiment of the invention disclosed herein, according to which the camshaft alternately simply comprises a tube, then on the tube) are not limiting of the present invention, and other means, known to those skilled in the art, may be alternatively adopted.

Figure 4C:
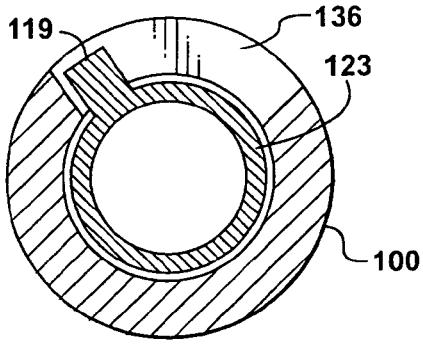
FIG. 4C depicts in transverse cross-section one embodiment of a mechanical fail-safe for limiting angular displacement of the drive member relative to the camshaft or tube.

Turning now to FIG. 4C, there is provided, in one embodiment of the present invention, a mechanical fail-safe by which angular displacement of the first drive member 120 relative to the tube or camshaft 100 may be limited. More particularly, there is provided in the wall of the tube or camshaft 100 a slot or groove 136 the angular dimensions of which define the maximum permissible angular movement of the first drive member 120 relative to the tube or camshaft 100. Projecting radially outwardly from stem portion 123 of the drive member 120 there is provided a tab or flange member 119 dimensioned to be slidingly received within the groove or slot 136. In the event of failure of the piston member 140, for whatever reason resulting in disassociation of the piston member and the first drive member, it will be appreciated that the tab or flange member 119 will abut an end-wall of the groove or slot 136 and thereafter be carried synchronously by the tube or camshaft 100 during rotation thereof.

Referring again to FIG. 3, the piston member 140 will be seen to comprise, according to the illustrated embodiment, a first longitudinally extending portion 141 slidingly received within internal passageway 124 of stem portion 123 through opening 135, and a second, coaxial longitudinally-extending portion 142. Both of the first portion 141 and the opening 135 include complementary non-circular cross-sections, so that first drive member 120 is rotatable with the piston member 140. The second portion 142 is characterized by an outer diameter slightly less than the diameter of passageway 101 in camshaft 100, and is sealingly engaged with camshaft 100 inner surface by suitable sealing means, such as the illustrated O-ring 143, which may be disposed in an annular channel (not visible) provided in the exterior surface of the second portion 142.

Referring also to FIG. 3A, the second portion 142 of the particularly illustrated piston member 140 is provided with both means for guiding the selective axial movement thereof within the passageway 101 and further for associating the piston member with the camshaft (or tube) for synchronous rotational movement. According to a first embodiment, shown in FIGS. 3 and 3A, such means may comprise at least one longitudinally extending groove or channel 145 defined in the exterior surface of the second portion 142, the at least one channel or groove 145 slidingly receiving therein a guide member 105 projecting radially inwardly from the camshaft 100. In the illustrated embodiment, two such channels or grooves 145 and corresponding guide members 105 are depicted, the same being arranged diametrically oppositely along the second portion 142. The guide members 105 may, as shown, be formed as indentations in the wall of the camshaft 100, or may be formed separately and mounted by known means. End wall 146 in each channel or groove 145 limits the movement of piston member 140 relative to the guide members 105 in at least a first direction (indicated by arrow B) of travel. In the illustrated embodiment, the forward (indicated by arrow A) axial movement of the piston member 140 is limited by abutment of the forward end surface of second portion 142 with the opposing end surface of stem portion 123, thereby eliminating the need to provide end walls in each channel or groove 145 oppositely of end walls 146. Alternatively, however, it will be appreciated that the extent of forward and rearward travel of the piston member may be defined by opposed stops or end-walls provided in each channel.

Figure 5A:
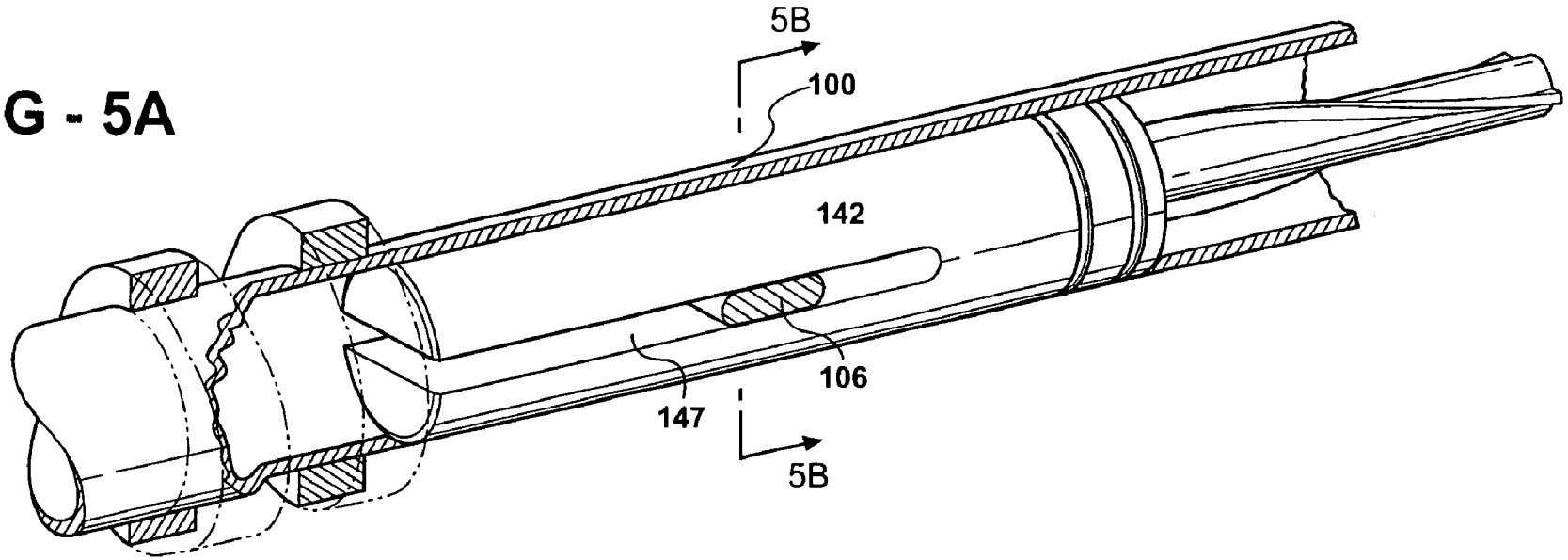
FIG. 5A comprises a cut-away perspective view of the inventive cam phaser depicting another embodiment thereof.
Figure 5B:
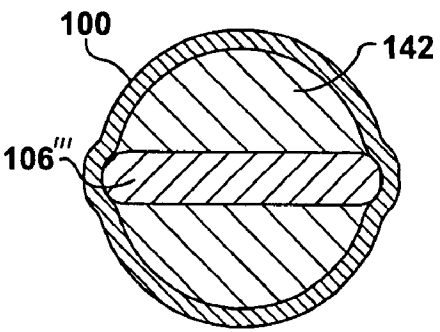
FIG. 5B comprises a transverse cross-section of the cam phaser as shown in FIG. 5A.

In an alternate embodiment, shown in FIGS. 5A and 5B, the guide means are shown to take the form of a longitudinally extending, transverse slot 147 defined in a principal length of the second portion 142, and a stationary guide member 106 fixedly disposed within the passageway 101 so as to be positioned within the slot 147. As shown in FIG. 5B, the guide member 107 may be press-fit into place within the passageway 101 of the camshaft or tube 100. However, alternative means for securing the guide member 107 in place are also possible.

As indicated, the piston member 140 is selectively axially moveable in at least first (A) and second (B) directions between at least first and second positions. With continuing reference to FIGS. 3 and 3B, a first embodiment for accomplishing such axial movement is shown. More particularly, and as best shown in FIG. 3B, the bearing support 104 will be seen to include at least a first annular groove or channel 108 provided on the exterior circumferential surface thereof, the annular groove or channel 108 further provided in communication with a radial passageway 110 defined through the bearing support 104 and communicating with a source of pressurized hydraulic fluid, such as air, oil, etc, which is ported, valved, and controlled so as to provide precisely varied volume and/or pressure, all according to known means. Such hydraulic fluid may, by way of non-limiting example, comprise engine oil employed to lubricate the internal combustion engine. And as is known in the art, augmenting means, including a secondary hydraulic pump or other separate pump may be employed to increase the pressure of the engine oil as needed to satisfy the oil pressure demands of such a hydraulic positioning means as herein described.

The camshaft 100 is provided with at least one opening 109 therein communicating the exterior of the camshaft 100 with the interior passageway 101. The opening 109 is further provided in communication with the radial passageway 110 of the bearing support 104. A similar arrangement is provided adjacent the opposite end of the second portion 142, as shown and indicated with corresponding numerals denoted with apostrophes. As will be appreciated by those skilled in the art, the communication of a suitable hydraulic fluid under pressure into the passageway 101 through the annular groove 108, the passageway 110, and the opening 109 will, provided that sufficient hydraulic fluid in the passageway 101 at the opposite end of the second portion 142 has been or is simultaneously evacuated, effect movement of the piston member 140 in the rearward direction B. Conversely, the communication of a suitable hydraulic fluid under pressure into the passageway 101 through the annular groove (not visible), the passageway 110', and the opening 109' will, provided that sufficient hydraulic fluid in the passageway 101 at the opposite end of the second portion 142 has been or is simultaneously evacuated, effect movement of the piston member 140 in the forward direction A.

As will be understood by those of skill in the art, the movement of sufficient pressurized hydraulic fluid into the passageway adjacent the piston member in the manner heretofore described may be controlled by conventional computer controller operative to determine the necessity for altering (through the mechanisms herein disclosed) the angular position of the camshaft relative to the crankshaft, operative to determine the degree of such alteration in angular positioning appropriate to current engine operating conditions, operative to determine the extent of axial movement required to achieve such alteration in angular positioning, and further operative to effect such alteration through the control of associated valves, etc.

Figure 6A:
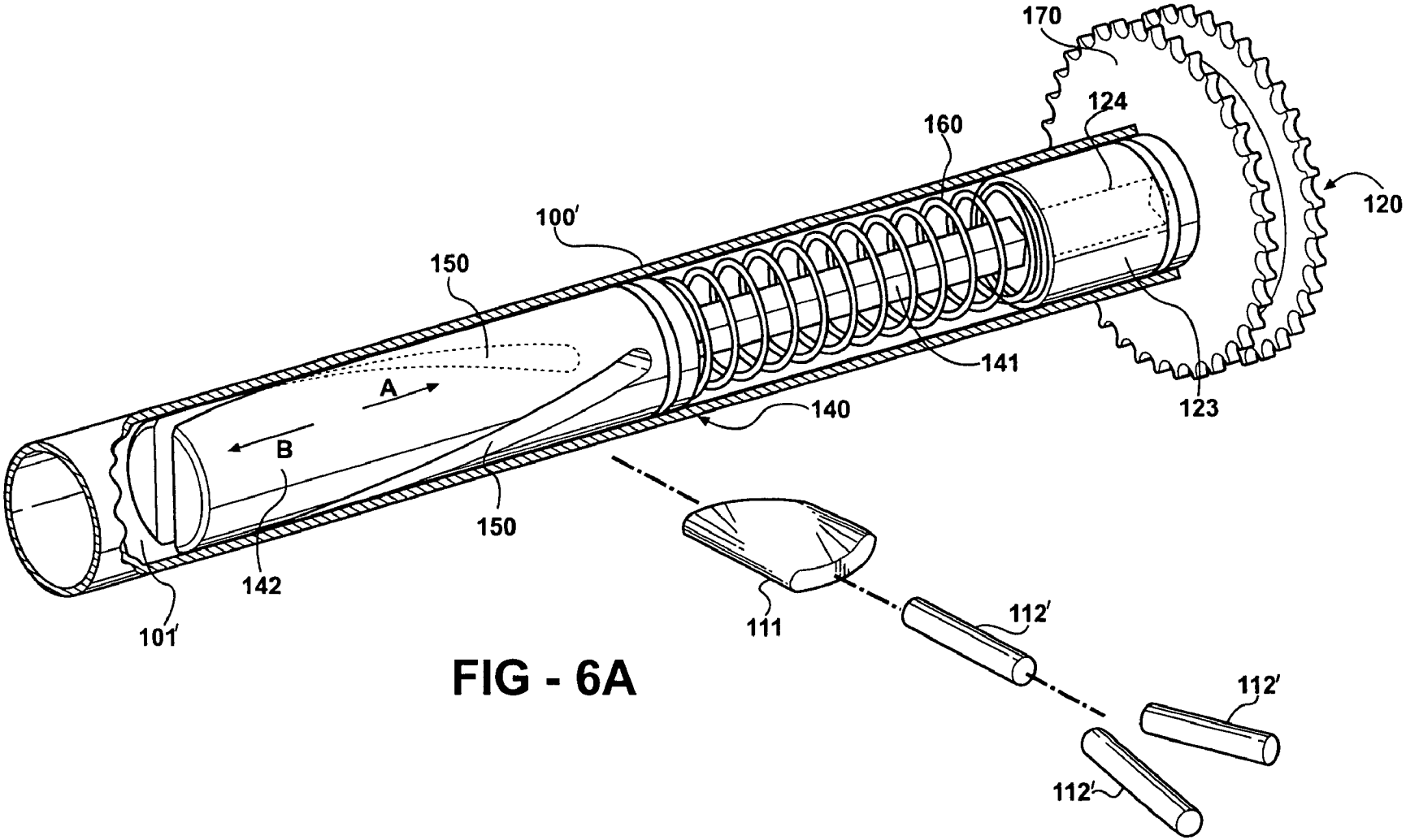
FIG. 6A comprises a cut-away perspective view of the inventive cam phaser depicting another embodiment thereof.

Turning now to FIG. 6A, which depicts a second embodiment of the inventive cam phaser comprising a separate tubular member 100' instead of a camshaft, a further embodiment for accomplishing axial movement of the piston member 140 will be seen to comprise a biasing member, such as the illustrated coil spring 160, disposed coaxially with the first portion 141 between opposing end surfaces of the stem portion 123 and second portion 142. The biasing member serves to bias the piston member 140 in a first position within the passageway 101, such as, for instance, a position corresponding to a preferred default angular position of the first drive member 120. According to this embodiment, hydraulic means (not shown) such as described above in relation to the embodiment of FIGS. 3 through 3B are provided to selectively axially move the piston member 140 in the forward direction A against the biasing force of the spring 160. As will be appreciated, partial or complete evacuation of hydraulic fluid from the passageway 101' behind the second portion 142 will result in movement of the piston member 140 in the opposite, rearward direction B under the force of the spring 160. Of course, the foregoing arrangement can be reversed; that is, the spring 160 or other biasing member may be disposed behind the second portion 142 to urge the piston member 140 into a second axial position thereof, with rearward movement in the direction B being accomplished by hydraulic means provided in front of the second portion 142.

It will be appreciated from the foregoing that, in either disclosed embodiment of the present invention (i.e., wherein the cam phaser comprises a camshaft 100 or wherein the cam phaser comprises a tubular member 100'), any of the foregoing means of accomplishing axial movement of the piston member 140, as well as other conventional substitutes therefore, may be employed.

To effect changes in the angular position of the first drive member 120, and thus vary the angular position of the camshaft relative to the angular position of the crankshaft, the piston member 140 includes, in the illustrated embodiment, a helical cam portion.

According to a first embodiment, shown in FIGS. 3 and 3B, the helical cam portion comprises at least one helical rib 148 extending radially from a central rod portion 149 of the first portion 141 of piston member 140. In the illustrated embodiment, two oppositely-handed ribs 148 are depicted, the ribs 148 projecting radially oppositely from the rod portion 149 (FIG. 3B). Further to this embodiment, the first drive member 120 includes a cam following portion which, in the illustrated form, comprises all or a portion of the passageway 124, which has a shape corresponding to the cross-sectional shape of the first portion 141. In this fashion, it will be appreciated that axial movement of the piston 140 will cause rotational movement of the drive member 120 through following movement of the cam following portion along the helical rib or ribs 148. As indicated, the cam following portion might comprise a portion of the passageway 124, rather than the entirety thereof. Thus, for example, the cam following portion may take the form of a keyway shape to the opening 135 in the stem portion 123 having a shape corresponding to the cross-sectional shape of the first portion 141, the remainder of the passageway 124 defining, for instance, a simple circular cross-section of sufficient diameter to facilitate axial sliding movement of the first portion 141 therein.

Figure 6B:
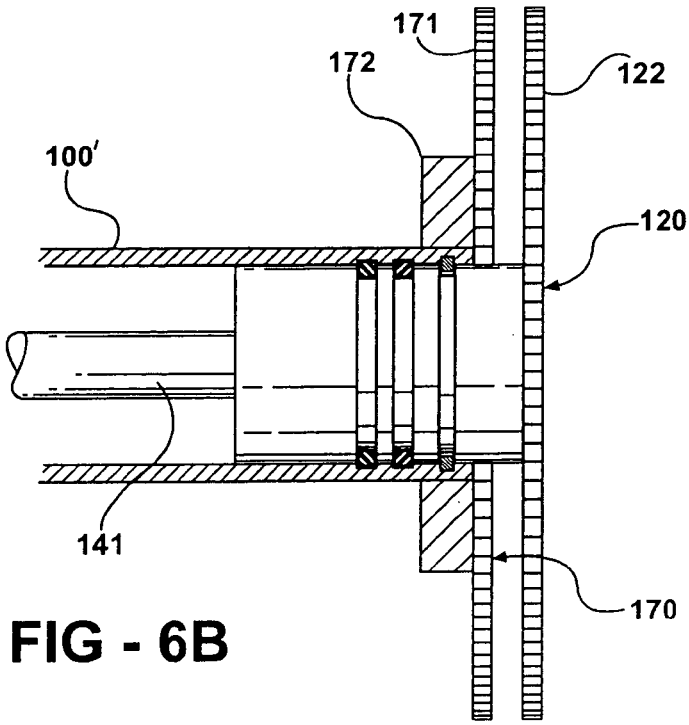
FIG. 6B is a detailed longitudinal, partial cross-section illustrating one means for mounting the first and second drive members in the embodiment of FIG. 6A.
Figure 6C:
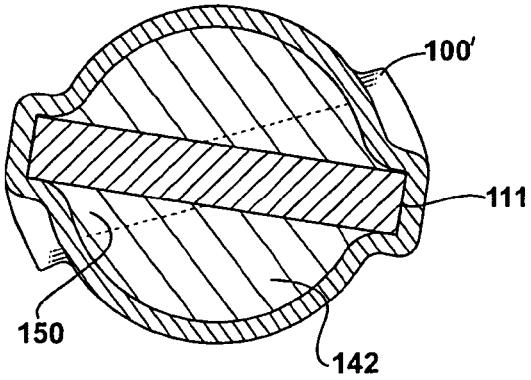
FIG. 6C is a transverse cross-section of the cam phaser as shown in FIG. 6A.

Alternatively, and as depicted in FIGS. 6A and 6C in combination with the embodiment of the present invention wherein the cam phaser comprises a rotatable tubular member 100' (mounted, for example, upon bearing supports) instead of a camshaft 100, the helical cam portion will be seen to comprise a transverse helical slot 150 defined in the second portion 142 of the piston member 140. According to this embodiment, the cam following portion comprises a stationary guide member, which may, by way of non-limiting example, take the form of the guide vane 111 or one or more guide pins 112, fixedly disposed within the passageway 101' so as to be positioned within the helical slot 152. As shown in FIG. 6C, the guide member may comprise one or more separate elements press-fit in place within the tube 100'. Alternatively, the guide member may be formed integrally with the tubular member 100'. As will be appreciated, the stationary guide members of this particular embodiment will likewise serve to ensure rotational movement of the piston member relative to the tube or camshaft.

Figure 6D:
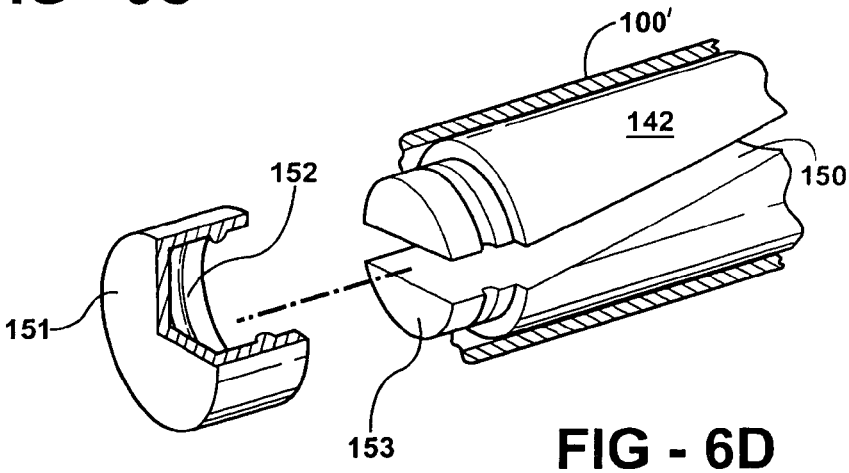
FIG. 6D depicts in a detailed, longitudinal partial cross-section a further embodiment of the cam phaser as shown in FIG. 6A.

To prevent torsional stress from expanding the helical slot 150 during selective movement of the piston member 140 in the manner heretofore described, a cap 151 may be disposed over an end of the second portion 142, as shown in FIG. 6D. More particularly, the cap 151 defines a blind bore 152 the internal diameter of which is dimensioned to receive therein a smaller-diameter terminal part 153 of the second portion 142. The cap 151 may be fixed to the terminal portion 153 of the second portion 142 by any known means including, as depicted, by the provision of an inwardly projecting circumferential bead or rib on the inner circumferential surface of the cap 151, and a corresponding annular groove or recess provided on the exterior surface of the terminal portion 153. Furthermore, it will be understood that the cap 151 may be provided with sealing means, such as, for instance, an O-ring disposed in an annular groove (not shown), where it is required to seal the second portion 142 relative to the interior passageway 101 of the camshaft 100.

Further to the foregoing embodiment, the first portion 141 of piston member 140 comprises a non-circular cross-section, such as the illustrated square shape, with all or a portion of the passageway 124 in stem portion 123 being correspondingly shaped, though of slightly greater dimensions, facilitate both synchronous rotation and sliding axial movement of the first portion 141 relative to the first drive member 120.

Referring again to FIG. 6A, the guide vane 111 will be seen to be characterized by an overall shape complementary to the shape of the helical slot 150 over a corresponding length thereof. Specifically, the guide vane 111 includes an upwardly inclined first lateral portion 114 and a downwardly inclined second lateral portion 115.

It will be appreciated that, according to this embodiment, axial movement of the piston 140 will, by means of the cooperative engagement between the helical slot 150 and the fixed guide member, such as guide vane 111 or guide pin(s) 112, cause rotational movement of the piston member 140 within the tubular member 100' and, correspondingly, rotational movement of the first drive member 120.

According to still another embodiment, not depicted, the helical cam portion of the piston member 140 may comprise a motor-driven helical screw or worm gear connected to, and operative to change the axial and rotational positions of, the piston member. Per this embodiment, the first portion 141 of piston member 140 comprises a non-circular cross-section, such as the illustrated square shape of FIG. 6A, for instance, with all or a portion of the passageway 124 in stem portion 123 being correspondingly shaped, though of slightly greater dimensions to permit sliding axial movement of the first portion 141 relative to the first drive member 120.

Referring to FIGS. 6A and 6B in particular, it will be seen that the present invention need not be disposed within the camshaft of an internal combustion engine, such as is shown and described in the embodiment of FIG. 3. Instead, the present invention may be adapted for disposition remote from the camshaft. More particularly, the embodiment of FIGS. 6A and 6B depict the piston member 140 and drive member 120 associated with a tubular member 100' rotatably mounted (such as on bearing Supports 104' (see FIG. 6B)) remote from, but in operative connection with, the camshaft (not shown) and crankshaft (not shown) by means of first 120 and second 170 drive members.

As previously, the first 120 and second 170 drive members may comprise sprockets 122, 171, such as shown, pulleys, gears, or other conventional means for operatively linking the drive members 120, 170 with their respective camshaft or crankshaft (not shown). The first drive member 120 comprises a drive member according to any of the embodiments previously described, and is operatively connected, as by a belt, chain, etc., to the camshaft for synchronous rotational movement therewith. The second drive member 170 is operatively connected, as by a belt, chain, etc., to the crankshaft for rotational movement therewith in a geared linkage, such as is known to those skilled in the art. The first 120 and second 170 drive members are mounted for synchronous rotatational movement, and further for the selective angular displacement of the first drive member 120, according to any of the means heretofore described, relative to the second drive member 170. Accordingly, rotational movement of the crankshaft (not shown) will rotatably drive each of the drive members 120, 170 and the camshaft (not shown), while variations in the angular position of the first drive member 120 relative to the second drive member 170 may be selectively effected to alter the timing of valve operation, all as described in detail previously.

Referring specifically to FIG. 6B, the stem portion 123 of the first drive member 120 is secured to the tube 100' for relative rotational movement (and against axial movement) by any of the several means previously described in relation to FIGS. 4A and 4B, or such other conventional means as are known, and is provided in cooperative engagement with the first portion of the piston member 141 to effect changes in the angular position of the first drive member 120, all as described elsewhere herein. The second drive member 170, in turn, is secured to the tube 100' and fixed thereto against relative rotational movement. While such fixed attachment of the second drive member 170 may be accomplished by numerous conventional means, in the illustrated embodiment the second drive member 170 comprises a ring-shaped adapter portion 172 dimensioned to be received over the exterior of the tube 100'. The sprocket 171 and adapter portion 172 of the second drive member 170 may be formed integrally with each other or, alternatively, may be formed separately and thereafter connected through any conventional means, including, without limitation, adhesive, fasteners, etc. The adapter portion 172 may be fixedly attached to the tube 100' by expanding the diameter of the tube 100' through ballizing or comparable process. Alternatively, and without limitation, the adapter portion 172 may be fixed by adhesive, by fastening means, or other conventional means.

Of course, the foregoing disclosure is exemplary of the invention only, and is not intended to be limiting thereof: Other modifications, alterations, and variations thereof, within the level of ordinary skill in the art, are certainly possible, with the benefit of this disclosure, without departing from the spirit and broader aspects of the invention as set forth in the appended claims.

The embodiments of the invention in which an exclusive property or privilege is claimed are defined as follows:

1. A cam phaser for selectively adjusting the angular position of a camshaft relative to the angular position of a crankshaft to thereby alter the timing of valve operation in an internal combustion engine, the cam phaser comprising:

a rotatable camshaft having an interior passageway, the camshaft including on an exterior surface thereof at least one cam operative to effect actuation of an engine inlet or outlet valve;

a first drive member operatively connectable to a crankshaft for rotational movement therewith, the first drive member independently rotatably associated with the camshaft; and a piston member axially moveably disposed entirely within the camshaft interior passageway and associated with the camshaft for synchronous rotation therewith, the piston member further being associated with the first drive member for synchronous rotation therewith and axial movement relative thereto; and wherein the first drive member comprises a cam following portion in sliding engagement with a helical cam portion of the piston member, whereby axial movement of the piston member effects a change in the angular position of the first drive member as the cam following portion moves along the helical cam portion.

2. The cam phaser of claim 1, wherein the first drive member comprises an axial passageway having an opening comprising the cam following portion, the piston member comprises a first portion axially slidingly received within the passageway through the opening, and wherein further the helical cam portion comprises at least one helical rib provided on the first portion of the piston member.

3. The cam phaser of claim 2, wherein the opening comprises a keyway shape complementary to the cross-sectional shape of the piston member first portion.

4. The cam phaser of claim 2, wherein at least a portion of the axial passageway is characterized by a cross-sectional shape complementary to the cross-sectional shape of the piston member first portion.

5. The cam phaser of claim 1, wherein the piston member is selectively axially moveable between at least first and second positions.

6. The cam phaser of claim 5, wherein the piston member is spring-biased to one or the other of the at least first and second positions.

7. The cam phaser of claim 5, wherein the piston member is selectively axially moveable by hydraulic pressure to one or the other of the at least first and second positions.

8. The cam phaser of claim 5, wherein the piston member is selectively axially moveable by hydraulic pressure between the at least first and second positions thereof.

9. A cam phaser for selectively adjusting the angular position of a camshaft relative to the angular position of a crankshaft to adjust the timing of valve operation in an internal combustion engine, the cam phaser comprising:

a rotatable tubular member having an interior passageway, the rotatable tubular member mountable within an internal combustion engine apart from either the engine crankshaft or camshaft;

a first drive member operatively connectable to one or the other of the engine camshaft or crankshaft for rotational movement therewith, the first drive member independently rotatably associated with the tubular member, and a second drive member operatively connectable to the other of the engine crankshaft or camshaft for rotational movement therewith, the second drive member being rotatably fixed relative to the tubular member for synchronous rotation therewith, and the first drive member being independently angularly positionable relative to the second drive member; and a piston member axially moveably disposed within the tubular member interior passageway and associated with the tubular member for synchronous rotation therewith, the piston member further being associated with the first drive member for synchronous rotation therewith and axial movement relative thereto, and wherein further axial movement of the piston member effects a change in the angular position of the first drive member relative to the second drive member.

10. The cam phaser of claim 9, wherein the piston member comprises a helical cam portion.

11. The cam phaser of claim 10, wherein the first drive member includes a cam following portion in engagement with the helical cam portion of the piston member, whereby axial movement of the piston member effects a change in the angular position of the first drive member relative to the second drive member as the cam following portion moves along the helical cam portion.

12. The cam phaser of claim 11, wherein the piston member comprises a first portion axially slidingly received within a passageway defined in the first drive member, the passageway including an opening, and wherein further the helical cam portion comprises at least one helical rib provided on the first portion of the piston member, and the opening comprises the cam following portion.

13. The cam phaser of claim 12, wherein the opening comprises a keyway the cross-sectional shape of which is complementary to the cross-sectional shape of the piston member first portion.

14. The cam phaser of claim 11, wherein the helical cam portion comprises a helical slot, and the cam phaser further includes a guide member disposed in the helical slot and rotatably fixed relative to the camshaft, whereby axial movement of the piston member effects a change in the angular position of the piston member and the first drive member rotatably associated therewith.

15. The cam phaser of claim 9, wherein the piston member is selectively axially moveable between at least first and second positions.

16. The cam phaser of claim 15, wherein the piston member is spring-biased to one or the other of the at least first and second positions.

17. The cam phaser of claim 15, wherein the piston member is selectively axially moveable by hydraulic pressure to one or the other of the at least first and second positions.

18. The cam phaser of claim 15, wherein the piston member is selectively axially moveable by hydraulic pressure between the at least first and second positions thereof.

19. A cam phaser for selectively adjusting the angular position of a camshaft relative to the angular position of a crankshaft to thereby alter the timing of valve operation in an internal combustion engine, the cam phaser comprising:

a rotatable camshaft having an interior passageway, the camshaft including on an exterior surface thereof at least one cam operative to effect actuation of an engine inlet or outlet valve;

a first drive member operatively connectable to a crankshaft for rotational movement therewith, the first drive member independently rotatably associated with the camshaft; and a piston member axially moveably disposed within the camshaft interior passageway and associated with the camshaft for synchronous rotation therewith, the piston member further being associated with the first drive member for synchronous rotation therewith and axial movement relative thereto; and wherein the piston member comprises a helical slot, and the cam phaser further includes a guide member disposed in the helical slot and rotatably fixed relative to the camshaft, whereby axial movement of the piston member effects a change in the angular position of the piston member and the first drive member rotatably associated therewith.

20. The cam phaser of claim 19, wherein the piston member is selectively axially moveable between at least first and second positions.

21. The cam phaser of claim 20, wherein the piston member is spring-biased to one or the other of the at least first and second positions.

22. The cam phaser of claim 21, wherein the piston member is selectively axially moveable by hydraulic pressure to one or the other of the at least first and second positions.

23. The cam phaser of claim 20, wherein the piston member is selectively axially moveable by hydraulic pressure between the at least first and second positions thereof.

* * * * *